United States Patent [19]

Liebetrau

[11] Patent Number: 4,571,902

[45] Date of Patent: Feb. 25, 1986

[54] PANEL MOUNTING SYSTEM AND METHOD FOR MOUNTING PANELS

[76] Inventor: Richard E. Liebetrau, 237 Petrie Rd., Cadillac, Mich. 49601

[21] Appl. No.: 552,406

[22] Filed: Nov. 16, 1983

[51] Int. Cl.[4] ..... E04G 21/04

[52] U.S. Cl. ..... 52/127.2; 52/127.7; 52/741; 52/DIG. 1; 52/768; 52/775

[58] Field of Search ..... 52/127.2, 127.7, 127.8, 52/741, 749, DIG. 1, 768, 772, 775

[56] References Cited

U.S. PATENT DOCUMENTS 3,477,751 11/1969 Bos ..... 52/768 X

FOREIGN PATENT DOCUMENTS 2000485 7/1971 Fed. Rep. of Germany ..... 52/772

660819 3/1965 France ..... 52/772

250235 7/1926 Italy ..... 52/772

372453 11/1963 Switzerland ..... 52/772

1075200 7/1967 United Kingdom ..... 52/127.2

*Primary Examiner*—Carl D. Friedman

*Assistant Examiner*—Naoko N. Slack

*Attorney, Agent, or Firm*—Bachman & LaPointe

[57] ABSTRACT

A panel mounting system and method for mounting panels employing a panel mounting temporary retainer for holding adjacent panels in place during glazing with and curing of structural silicone sealant or other suitable adhesive wherein the retainer is readily accepted by the structural member without the need of drilling and tapping holes in the member and wherein the retainer is readily installed from the interior of the building.

12 Claims, 4 Drawing Figures

PANEL MOUNTING SYSTEM AND METHOD FOR MOUNTING PANELS

BACKGROUND OF THE INVENTION

The present invention relates to a glazing system and, more particularly, a temporary retainer for use in butt glazing systems which utilize structural silicone sealant or other suitable adhesive for the structural containment of the glazing material by adhesion.

In butt glazing systems, after the glazing material (usually glass) and the backer material are positioned in place, structural silicone sealant or other suitable adhesive is gunned into the voids between the interior face of the glazing material and the exterior face of the structural member such as a vertical mullion member. Once the joints are completely filled with the structural silicone the silicone is immediately tooled before skim cure can begin. When the glass is in place as set forth above it is subjected to both positive and negative windloading which tends to force the glass inwardly and outwardly respectively. Once the structural silicone sealant or other suitable adhesive has fully cured, usually from fourteen to twenty-one days after application, the positive windload is resisted by putting the seals and backer in compression while the negative windload is resisted by putting the seals in tension as the adhesive has structurally adhered to the interior face of the glazing material, that is, glass, and the exterior face of the structural member.

During the period of time between the application of the adhesive and when the adhesive is fully cured, it is necessary to hold the glass in place against the force of negative windloads which would pull the uncured silicone seals apart. In order to hold the glass in place it is common in the art to employ a temporary glazing retainer which is secured to the structural member. A typical glazing system employing a temporary glass retainer is PPG Industries EFG Glazing System 502. The PPG system and other known glazing systems employing temporary glass retainers require drilled or drilled and tapped holes in the structural member in order to secure the temporary retainer in place. Some methods incorporating retainers must be installed from the exterior of the building which, quite obviously, is more costly than if installation could be accomplished from the building interior.

Naturally, it is highly desirable to develop a temporary glass retainer for use in a butt glazing system wherein the structural member readily accepts the temporary retainer without the necessity of drilling and tapping holes in the structural member. The temporary retainer should be readily installed from the interior of the building.

Accordingly, it is a principal object of the present invention to provide an improved butt glazing system which employs a temporary retainer for the glazing material.

It is a principal object of the present invention to provide an improved butt glazing system wherein the temporary retainer is readily accepted by the structural member without the need of drilling and tapping holes in the member.

It is a further object of the present invention to provide an improved butt glazing system wherein the temporary retainer is readily installed from the interior of the building.

Further objects and advantages of the present invention will appear hereinbelow.

SUMMARY OF THE INVENTION

In accordance with the present invention the foregoing objects and advantages are readily obtained.

The present invention relates to a glazing system and, more particularly, a panel mounting temporary retainer for use in butt glazing systems which utilize structural silicone sealant or other suitable adhesive for the structural containment of the glazing material by adhesion. In accordance with the present invention a glazing system wherein a plurality of closely spaced adjacent panels are secured to a structural member by structural silicone sealant or other suitable adhesive comprises a structural member formed with a slot which receives a panel mounting temporary retainer for holding the adjacent panels in place during glazing with the structural silicone sealant or other suitable adhesive. The retainer comprises an elongated stem having a pair of projections radiating from the stem at one end thereof. A flange is provided on the elongated stem and is spaced from the projections on the stem. A multi-sided section (preferably hexagonal in shape) is formed on a portion of the stem intermediate the pair of projections and the flange. The pair of projections are rotated in a slot provided on the structural member and, upon rotation of the retainer, wedged securely within the slot of the structural member thereby holding the temporary retainer rigidly in place. In accordance with the method of the present invention a first panel is placed relative to the structural member. The temporary retainer is then mounted in the slot provided on the structural member and rotated to a first position wherein the pair of projections on the retainer are secured in the slot and the flange on the retainer holds the first panel in place. A second panel is then located in place relative to the structural member and close to and adjacent the first panel. The panel mounting temporary retainer is then rotated to a second position wherein the flange holds both the first panel and the second panel in place with respect to the structural member.

In accordance with the present invention the panel members may readily be installed from the interior of the building thereby resulting in reduced construction costs. The retainer is readily accepted by the structural member without the need of drilling and tapping holes into the structural member.

DETAILED DESCRIPTION

Figure 1:
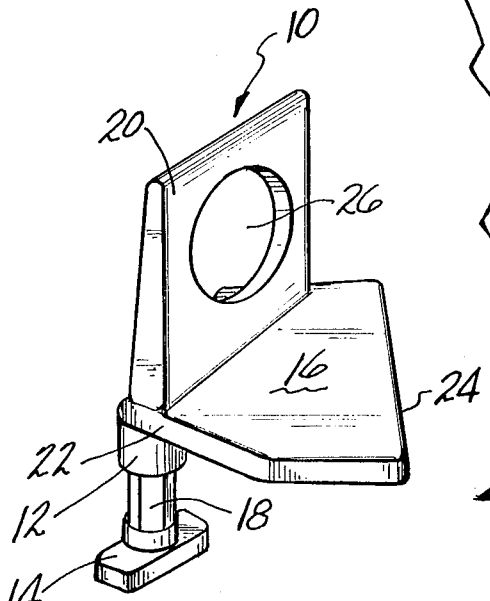
FIG. 1 is a perspective view illustrating the panel mounting temporary retainer of the present invention.

With reference to the figures, FIG. 1 shows the panel mounting temporary retainer 10 of the present invention which is used in the glazing system in accordance with the present invention. The retainer 10 has an elongated stem portion 12 which is provided on one end thereof with a pair of radiating projections 14. Mounted on the elongated stem 12 at a distance spaced from the projections 14 is a flange 16 which is in the shape of a concave polygon. Formed on the elongated stem 12 intermediate the projections 14 and the flange 16 is a multi-sided section 18 which, as shown, is in the form of a hexagon. On the end of the elongated stem 12 remote from the pair of projections 14 is a handle 20. The concave polygonal flange 16 is provided with a first circumferential surface 22 and a second circumferential surface 24 for reasons to be made clear hereinbelow. The retainer 10 may be formed from any suitable material such as molded plastic or the like and preferably a glass filled reinforced plastic. The length of elongated stem 12 may be varied from one piece to the next so that the retainer is able to accompany panels of any thickness.

Figure 4:
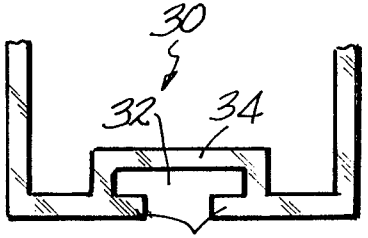
FIG. 4 is an illustration of the structural member used in combination with the temporary retainer of the present invention.

With reference to FIG. 4 there is shown a structural member 20 which may be used in combination with retainer 10 in the glazing system of the present invention. The structural member 30 is provided with a T-shaped slot 32 for receiving the projections 14 on the retainer 10 in a manner to be discussed in detail hereinbelow. As illustrated in FIG. 4 a continuous T-shaped slot 32 is formed in the structural member 30. The continuous T-shaped slot 32 allows multiple retainers to be used in any location desired. It should be appreciated that in the event of a structural member having a flat exterior surface, a T-shaped slot metal clip could be secured to the member. Projections 14 would then be metal projections molded into the stem.

Figure 3:
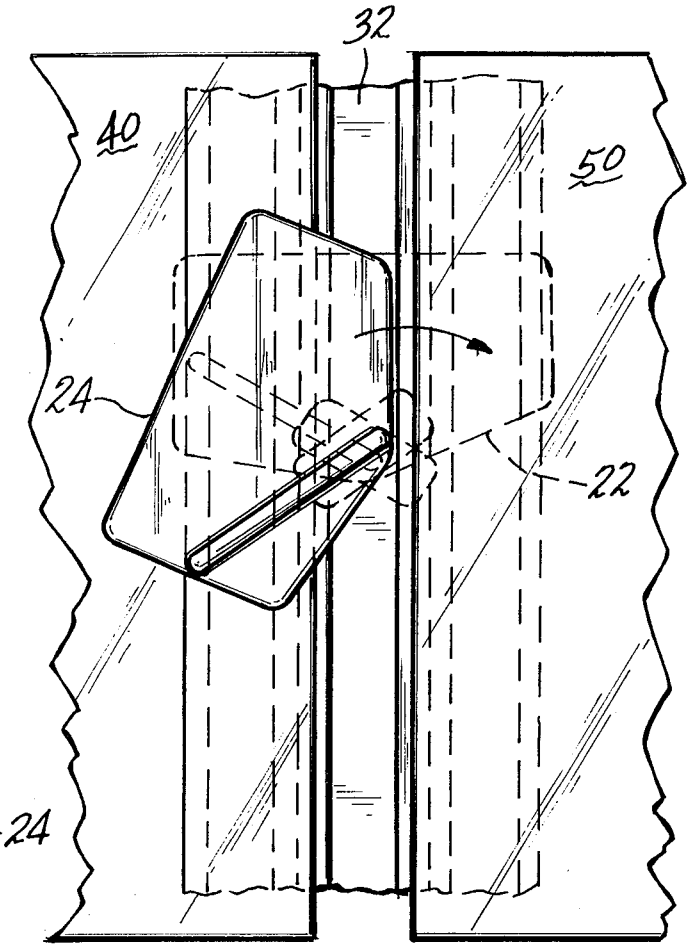
FIG. 3 is an illustration of the glazing system of the present invention employing the temporary retainer of the present invention with the temporary retainer being in its second position for holding both a first and a second panel in place.
Figure 2:
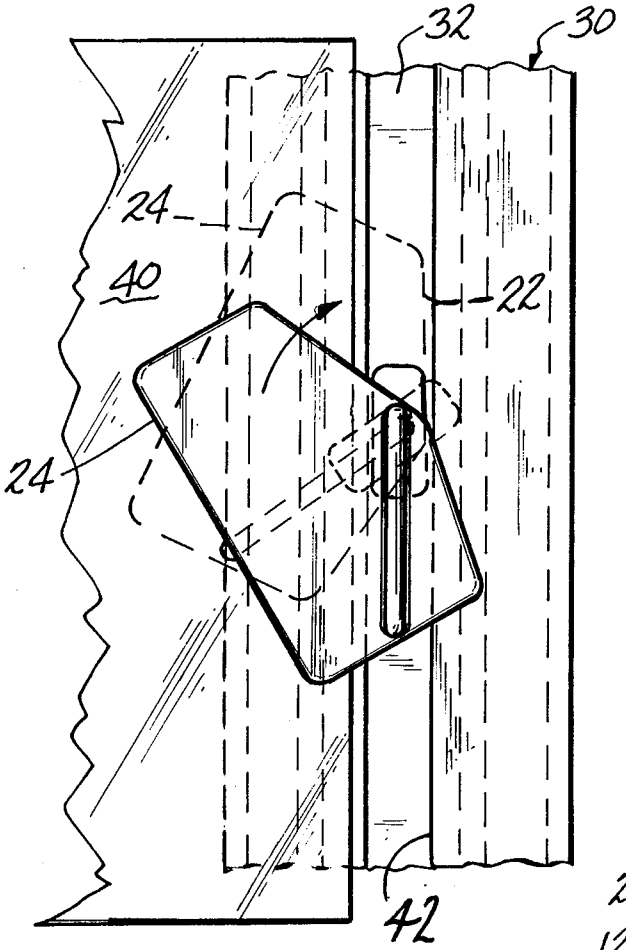
FIG. 2 is an illustration of the glazing system of the present invention employing the temporary retainer of the present invention with the temporary retainer being in its first position for holding a first panel in place while allowing for placement of a second panel adjacent to the first panel.

With reference to FIGS. 2 and 3, the glazing system of the present invention employing the panel mounting temporary retainer 10 of the present invention will be described. After the first panel 40 is located in place, the installer, working from inside the building, reaches around the structural member 30 provided with T-shaped slot 32 and inserts the end of retainer 10 having the projections 14 into the T-shaped slot as shown in solid lines in FIG. 2. Grasping the handle 20 the installer now rotates the retainer in a clockwise direction until the circumferential surface 22 of the polygonal flange is substantially parallel with the vertical edge 42 of the panel which was previously installed as shown in phantom lines in FIG. 2. In this position, the retainer 10 holds panel 40 in place while the projections 14, having been press fit into the spaces defined by the backwall 34 and front walls 36, securely hold the retainer in the structural member 30. In this position the retainer, as noted above, maintains the panel 40 in place while still allowing access for the next panel 50 to be installed. After the panel 50 is located in place the installer can insert the open end of a wrench between the interior face of the panel 50 and the exterior surface of the structural member 30 such that the open end of the wrench engages the hexagonal portion 18 of the stem 12. As can be seen in FIG. 3, the retainer is then turned in a clockwise direction, using the wrench (not shown) on the hexagonal portion 18 of the stem 12, until surface 24 of the flange 16 lies substantially perpendicular to the vertical edges of the panels 40 and 50. In this position, the retainer now holds both panels 40 and 50 in place. The structural silicone sealant or other suitable adhesive is then gunned into the voids between the interior face of the panel and the exterior surface of the structural member as in traditional butt glazing systems and allowed to cure. Once the structural silicone sealant or other suitable adhesive is cured the temporary retainer 10 can be removed from the structural member 30. This is usually done from the outside of the building and usually done during the weathering sealing operation or the perimeter caulking operation. The retainer is removed by the workmen by simply grasping the handle 20 with finger hole 26 and turning the retainer counterclockwise to the position shown in solid lines in FIG. 2. The retainer 10 with projections 14 is then removed from the T-shaped slot 32. As can be seen, the retainers are reusable items.

Thus, by way of the present invention an improved glazing system which employs a temporary retainer which is readily installed in the structural member from the interior of the building is obtained.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In a building glazing system having a plurality of closely spaced adjacent panels secured to a structural member by an adhesive wherein said adjacent panels are held in place against the force of windloads until said adhesive is fully cured comprising a slot provided on said structural member, a panel mounting temporary retainer having first and second portions, said first portion comprising a body having means for securely receiving said panel mounting temporary retainer in said slot on said structural member in a rotatable fashion for holding said panel mounting temporary retainer rigidly on said structural member and said second portion comprising a body having means extending therefrom for holding said plurality of closely spaced adjacent panels in place relative to said structural member during the application and curing of the adhesive, said means for holding said plurality of closely spaced adjacent panels in place comprises a flange having a circumferential shape such that when said panel mounting temporary retainer is in a first position said flange holds a first panel in place while allowing a second panel to be located in place and when in a second position said flange holds both said first panel and said second panel in place.

2. In the building glazing system of claim 1 wherein said panel mounting temporary retainer has a third portion extending between said first portion and said second portion, said third portion comprising an elongated stem member traversing the space defined between said plurality of closely spaced adjacent panels.

3. In the building glazing system of claim 2 wherein at least a portion of said elongated stem member includes means for receiving a tool for turning said panel mounting temporary retainer in said structural member.

4. In the building glazing system of claim 3 wherein said means for receiving a tool comprises a multi-sided section.

5. In the building glazing system of claim 4 wherein said multi-sided section is in the shape of a hexagon.

6. In the building glazing system of claim 1 wherein said slot is a T-shaped slot extending the length of said structural member.

7. In the building glazing system of claim 1 wherein said slot is made in said structural member.

8. In the building glazing system of claim 1 wherein said flange is in the shape of a concave polygon.

9. In the building glazing system of claim 1 wherein said means for securely receiving said panel mounting temporary retainer in said slot comprises a pair of projections.

10. A method of glazing a plurality of closely spaced adjacent panels to a structural member using adhesives comprising the steps of providing a slot on said structural member, locating a first panel in place relative to said structural member, positioning a first portion of a panel mounting temporary retainer in said slot, rotating said panel mounting temporary retainer to a first position wherein said first portion thereof is secured in said slot and a second portion thereof holds said first panel in place, locating a second panel in place relative to said structural member close to and adjacent said first panel and rotating said panel mounting temporary retainer to a second position wherein said first portion thereof is secured in said slot and said second portion thereof holds said first panel and said second panel in place.

11. A method according to claim 10 including the steps of gripping a third portion of said panel mounting temporary retainer which extends between said first portion and said second portion and traverses the space defined between said first and second closely spaced adjacent panels with a tool for rotating said panel mounting temporary retainer to said second position from said first position.

12. A method according to claim 10 including forming a continuous T-shaped slot in said structural member.

* * * * *